US007665637B2

(12) United States Patent
Foster

(10) Patent No.: US 7,665,637 B2
(45) Date of Patent: Feb. 23, 2010

(54) SELF-VENTING SPORTS TYPE CLOSURE

(75) Inventor: David Edward Foster, Peterborough (GB)

(73) Assignee: Rexam Closures and Packaging Services (UK) Limited, London (GB)

( * ) Notice: Subject to any disclaimer, the term of this patent is extended or adjusted under 35 U.S.C. 154(b) by 897 days.

(21) Appl. No.: 10/501,190

(22) PCT Filed: Jan. 9, 2003

(86) PCT No.: PCT/AU03/00016

§ 371 (c)(1),
(2), (4) Date: Mar. 4, 2005

(87) PCT Pub. No.: WO03/057584

PCT Pub. Date: Jul. 17, 2003

(65) Prior Publication Data

US 2005/0139621 A1 Jun. 30, 2005

(30) Foreign Application Priority Data

Jan. 10, 2002 (AU) ..... PR9912

(51) Int. Cl.
*B67D 3/00* (2006.01)
*B67D 5/06* (2006.01)

(52) U.S. Cl. ..... 222/521; 222/525; 215/313; 220/780; 220/794

(58) Field of Classification Search ..... 222/499, 222/521, 525, 519, 520, 522; 215/313; 220/780, 220/783, 794

See application file for complete search history.

(56) References Cited

U.S. PATENT DOCUMENTS 2,493,086 A * 1/1950 Reifsnyder ..... 229/125.25
4,401,227 A * 8/1983 Pehr ..... 215/252
4,424,918 A * 1/1984 Stull ..... 222/153.14
5,810,185 A 9/1998 Groesbeck
6,290,108 B1 9/2001 Gross

FOREIGN PATENT DOCUMENTS

| | | | |
|---|---|---|---|
| EP | 0 709 301 | A2 | 5/1996 |
| EP | 0 502 716 | B1 | 7/2001 |
| GB | 2 117 360 | A | 10/1983 |
| WO | WO 98/55368 | | 12/1998 |
| WO | WO 00/64774 | | 11/2000 |
| WO | WO 00/64774 | A1 | 11/2000 |
| WO | WO 02/40367 | A2 | 5/2002 |

* cited by examiner

*Primary Examiner*—J. Casimer Jacyna

(57) ABSTRACT

A closure (5) suitable for mounting onto a container (80). A closure comprises a main closure (10) having a top portion (11) that has an aperture (32) therethrough and a skirt (12) depending downwardly from the top portion (11) that is attachable to the container. A sealing rib (16) extends inwardly from the inner surface of the main closure (10) and is adapted to form a seal with the end portion of the container (80). A spout (33) extends upwardly from the top portion (11) and defines a bore that is in fluid communication with the aperture (32) in the top portion (11). A plug (36) having radially outer surface is mounted to the spout (33). The closure further comprises a top cap (50) that is mountable to the spout and is relatively movable between a first position where the plug (36) seals an opening in the top cap (5) and at least a second position where the plug (36) is withdrawn from the opening. On relative movement of the top cap (50) from the first position towards the second position, a sealing member (59) of the top cap (50) rides up over one or more protuberances (40) extending outwardly from the spout so as to at least partially release the seal made by the sealing member (59) with the spout (33).

21 Claims, 5 Drawing Sheets

SELF-VENTING SPORTS TYPE CLOSURE

TECHNICAL FIELD

The present invention relates to a closure for a container. More particularly, the invention relates to a resealable push-pull type closure that provides resealable access to the contents of a container.

BACKGROUND ART

Resealable push-pull closures (or as they are sometimes called, "sports closures") allow a person to pour out a container's contents without the need to fully remove the closure from the container.

Such closures typically comprise a main cap that seals the container in the manner of normal closures as known in the art. The top surface of the main cap normally has an opening in fluid communication with the bore of a spout. The spout in turn has a plug member that partially blocks the bore. To seal the container, a top cap, which also has an aperture, is mounted to the spout. The top cap is normally movable between at least a first position in which its aperture is sealed by the plug member so sealing the container and a second position in which the aperture is not sealed by the plug member so allowing the container's contents to exit from the container around the plug member and through the aperture of the top cap.

The top cap is generally mounted to the spout in a manner such that it is readily movable between the first and second positions by only one hand or even by the teeth. This traditionally has made the closure popular with sportspersons, such as runners or cyclists, who may wish to consume a product but who may only have one hand free whilst participating in their sport.

The use of such a closure is, however, not restricted only to containers for sports drinks and they have found application in an ever wider range of container types and products in general use by consumers. For example, the closures have been used to seal containers containing beverages marketed at children. The closures are often easier to unseal than the traditional requirement of fully unscrewing a closure from the container. The smaller opening in the top cap also restricts the rate of flow of the beverage from the container making it easier for a child to consume the beverage without mess.

Containers for carbonated beverages must be sealed by closures that can withstand the increase in pressure created Within the container by the carbonation of the beverage. The closures must also retain a sufficient degree of sealing to prevent loss of gas from the container in the time between filling of the container and eventual consumption of the beverage by the consumer.

U.S. Pat. No. 5,423,444 discloses a plastic closure for a container having an externally screw threaded neck that can be used for carbonated beverages.

The closure in U.S. Pat. No. 5,423,444 has a top portion and an internally threaded skirt. An annular sealing rib also projects downwardly from the underside of the top portion. The rib includes a first substantially cylindrical portion contiguous with the underside of the top portion and lying adjacent to or abutting with the skirt, and a second, frusto-conical, portion contiguous with the end of the first portion distal to the underside of the top portion and extending radially inwardly to a circular free edge. During threaded attachment of the closure with the neck, the second, frusto-conical, portion is engaged by a free end of the neck and folded back at least towards and preferably against the first portion of the rib to form a gas tight seal between at least the outer surface of the neck of the container and the closure.

U.S. Pat. No. 5,609,263 discloses a closure having a sealing rib in which there is at the free end of the second portion of the rib a thick seal ring of substantially circular cross-sectional shape. The rib and the seal ring are dimensioned to engage the free end of the neck when the closure is threaded onto the neck such that when the neck is fully screwed into the closure its free end crushes the seal ring directly against the inside surface of the top portion of the closure.

Australian Patent Application No 80944/98 discloses still further variants of the closure described in U.S. Pat. No. 5,423,444. In one variant, the sealing rib of the closure has a third portion connected to the second portion at or adjacent its circular edge and extending generally in a direction away from the top portion. The third portion is substantially no thicker than the second portion and has a length longer than its thickness. On attachment of this closure to a container, the third portion is positioned between the neck of the container and the underside of the top portion of the closure.

International Publication No WO 00/64774 (Appl. No. PCT/AU00/00353) describes one type of resealable push-pull closure.

The present invention is directed to a modified resealable push-pull closure that is suitable for, but not limited to, sealing containers for aerated or at least partially carbonated beverages.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

DISCLOSURE OF THE INVENTION

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The present application is directed to a first invention comprising a closure suitable for mounting onto a container, the container having an end portion defining a container opening, the closure comprising:

- a main closure having:
  - a top portion having an aperture therethrough;
  - a skirt portion depending downwardly from the top portion that is attachable to the container end portion;
  - a sealing rib that, on attachment of the main closure to a container, forms a seal with the end portion of the container;
  - a spout extending upwardly from the top portion, the spout defining a bore that is in fluid communication with the aperture in the top portion, an outer surface of the spout having at least one outwardly extending protuberance thereon; and
  - a plug member having a radially outer surface and mounted to the spout; and
- a top cap mounted to the spout, the top cap having an upper portion that has an inner surface defining an opening through the upper portion, the opening being in fluid communication with the bore of the spout, a skirt portion depending downwardly from the upper portion, and a sealing member extending inwardly from an inside surface of the top cap;

the top cap being relatively movable between a first position where the plug member is at least partially within the opening and the sealing member forms a seal with the outer surface of the spout and at least a second position where the plug member is withdrawn from the opening; and wherein on relative movement of the top cap from said first position towards said second position, the sealing member rides up over said at least one protuberance so as to at least partially release the seal made by the sealing member with said spout.

The provision of the at least one protuberance on the outer surface of the spout is adapted to break the seal of the sealing member as the top cap moves relatively upwardly on the spout from its first position. As this seal is broken, a seal formed between the plug member and the top cap is preferably maintained. This serves to preferably ensure that any pressure in the container is initially released downwardly and out of the bottom end of the top cap. This has the advantage of stopping a sudden release of pressure through the opening in the top portion of the top cap on movement of the top cap from its first position towards its second position.

The position of the said at least one protuberance is also preferably such that the sealing member re-seals with the outer surface of the spout on or prior to the top cap reaching its said second position. This has the advantage of ensuring that the contents of the container only exit the closure through the opening in the top portion of the top cap when a user is pouring out the container's contents, with none of the contents dribbling or escaping down the outer surface of the spout and out a bottom end of the top cap distal the top portion.

In one embodiment, the outer surface of the spout can have a plurality of outwardly extending protuberances thereon. For example, there can be between about 10 and 30 protuberances extending outwardly from the outer surface of the spout, more preferably between about 15 and 20 protuberances, and most preferably about 18 protuberances, extending outwardly from the outer surface of the spout.

In a further embodiment, the protuberances can be circumferentially disposed on the outer surface of the spout. The protuberances can also be equally spaced on the outer surface of the spout.

The protuberances can be any suitable shape so long as they meet the desired requirement of at least partially releasing the seal made by the top cap with the side wall of the spout on initial movement of the top cap from its sealed to its unsealed condition. In one embodiment, two, more, or all of the protuberances can have the same shape. In a further embodiment, the protuberances can be rectangular in shape. The protuberances can be about 1.1 mm wide, about 1.3 mm high and be spaced apart by a distance of about 1.1 mm. Each protuberance can also extend out from the spout for a distance or thickness of about 0.1 mm.

In a preferred embodiment, the lower and/or upper edges of one, more or all of the protuberances can be joined to the external wall of the spout with a relatively smooth transition. In a preferred embodiment, the transition from the surface to the spout to both the upper and lower surfaces of each protuberance is smoothly curved. The relatively smooth transition preferably serves to allow the seal of the top cap to move over the protuberance without catching on an undercut or other obstruction.

One or more the sidewalls of each protuberance preferably extend upwardly from the surface of the spout. In one embodiment, the sidewalls can extend substantially or exactly perpendicularly to the surface of the spout. Adjacent sidewalls of respective protuberances preferably define a channel for the release of gases between the external surface of the spout and the top cap on temporary release of the seal made by the seal of the top cap with the spout as it rides up over the protuberances.

In a preferred embodiment, the skirt portion of the top cap is substantially cylindrical.

The sealing member can comprise an annular sealing rib that on mounting of the top cap to the spout in said first position seals with the outer surface of the spout below the protuberances thereon. In one embodiment, the sealing member can extend inwardly from an inner surface of the skirt portion of the top cap.

The annular sealing rib can include a first portion which is contiguous with an inner surface of the skirt portion of the top cap and at least a second portion contiguous with the first portion, the second portion, prior to mounting of the top cap to the spout, extending radially inwardly to a circular free edge. The second portion can extend inwardly and downwardly to the circular free edge. On mounting of the top cap to the spout, the second portion is preferably folded back at least towards the first portion. Still further, the second portion can be folded back against the first portion on mounting of the top cap to the spout. In this embodiment, the second portion of the sealing rib can be frusto-conical. Once the sealing rib has been folded back towards the inside surface of the skirt portion when the top cap is mounted to the spout, the secondary rib will preferably normally substantially retain this position during any subsequent movement of the top cap between its first position and its second position.

In another embodiment, the sealing member of the top cap can comprise a sealing rib that, prior to mounting of the top cap to the spout, extends inwardly from an inner surface of the top cap to a circular edge. In this embodiment, the sealing rib can extend inwardly and downwardly to a circular free edge from the inner surface of the top cap. On mounting of the top cap to the spout, the sealing rib can be folded back at least towards the inner surface of the top cap. Still further, the sealing rib can be folded back against the inner surface of the top cap. As in the other embodiment, the sealing rib can be frusto-conical.

In a still further embodiment, the sealing member can comprise an annular contact bead that on mounting of the top cap to the spout in said first position seals with the outer surface of the spout below the protuberances thereon.

Prior to the plug member firstly entering the opening in the upper portion of the top cap, an annular sealing rib also preferably extends inwardly from the upper portion at least partially across the opening to a free edge, the inner surface of the opening having an internal diameter relative to the external diameter of the plug member such that when the plug member firstly enters the opening, at least a portion of the sealing rib is engaged by the plug member and folded back towards the inner surface of the opening to form a seal between at least the outer surface of the plug member and the top cap. Once the sealing rib of the top cap has been folded back towards the inner surface as the plug member firstly enters the opening in the upper portion, the sealing rib will normally and preferably substantially retain this position during any subsequent movement of the top cap between its first position and second position.

In this case, the inner surface of the opening in the upper portion of the top cap is preferably substantially cylindrical and extends from an upper side to an underside of the upper portion.

The annular sealing rib extending inwardly from the upper portion of the top cap, prior to the plug member firstly entering the opening in the upper portion of the top cap, can have at least a frusto-conical portion extending radially inwardly to a circular free edge.

Still further, the inside surface of the skirt portion of the top cap can have an attachment mechanism complementary to an attachment mechanism on an external surface of the spout. The complementary attachment mechanisms can comprise a thread adapted to engage a corresponding thread on the external surface of the spout. Where the attachment mechanism comprises a thread, a turn of the top cap in one direction will preferably move the top cap from the first position to at least the second position and a turn in an opposite direction will move the top cap from the second position to at least the first position.

In one embodiment, the thread on the inside surface of the skirt portion of the top cap comprises two or more thread segments.

In one embodiment, the thread on the external surface of the spout is a recessed thread adapted to receive the complementary thread of the top cap. Where the thread on the inside surface of the skirt portion comprises a number of thread segments, the recessed thread on the spout is preferably comprised of an equal number of recesses spaced to receive the thread segments when the top cap is mounted to the spout. Each recess preferably includes an upwardly directed ramp member so located that on rotation of the top cap relative to the spout, the thread segments of the skirt portion enter the ramp member so moving the top cap relatively upwardly on the spout. The ramp member is preferably formed at an angle between 10 and 60 degrees, more preferably about 45 or about 30 degrees, relative to a notional radial plane normal to the longitudinal axis of the spout. When the top cap is firstly mounted to the spout, the top cap can be preferably pushed onto the spout such that the thread of the top cap engages within the recessed thread on the external surface of the spout.

The plug member is preferably located at or adjacent an end of the spout distal the opening in the top portion of the main closure. In one embodiment, the plug member can be partially or wholly outside said distal end of the spout. In another embodiment, the plug member can be partially or wholly inside the spout. In a still further embodiment, the plug member can be partially in and partially outside the spout. An aperture, such as an annular aperture can exist between the plug member and the spout wall, the aperture being spanned by a plurality of bridge members that extend radially inwardly from the spout to support the plug member. Where the plug member is wholly or partially outside said distal end of the spout, the bridge members preferably extend inwardly and upwardly to the plug member.

The plug member preferably comprises a tube having a substantially cylindrical outer surface that is sealed at one end. The outer surface preferably extends upwardly beyond the extent of the free or distal end of the spout wall such that the sealed end is distal the free or distal end of the spout.

The sealing rib of the main closure can comprise an annular sealing rib adapted to seal with the end portion of the container. The sealing rib can project downwardly from an underside of the top portion and include a first portion which is contiguous with the top portion and has an inner surface, which inner surface lies radially inwardly of the skirt portion. The rib can also have at least a second portion contiguous with the first portion and separated from the top portion by the inner surface of the first portion, the second portion extending at least radially inwardly to a circular edge. The inner surface of the first portion can have an internal diameter relative to the external diameter of the end portion of the container to which the main closure is to be attached such that during attachment of the main closure with the end portion of the container, the sealing rib will be engaged by the end portion of the container so folding the second portion at least towards the inner surface of the first portion of the rib to form a seal between at least an outer surface of the end portion of the container and the main closure.

The end portion of the container to be sealed by the present invention preferably has a free end, an outside, preferably cylindrical, surface and an inside, preferably cylindrical, surface, the inside surface defining a bore. One of or both of the joins between the free end and the inside surface and between the free end and the outside surface can be smoothly curved and define respectively what are hereinafter called the inner and outer sealing radii of the end portion of the container.

The main closure is preferably provided with a screw thread on an inside surface of its skirt portion adapted to engage with a corresponding thread on an external surface of the end portion of the container. It is, however, possible for the container and the main closure to be formed with other complementary attachment mechanisms. Such an arrangement could, for instance, comprise a snap-on arrangement having a rib on the inside surface of the main closure and a corresponding groove on the outside surface of the end portion of the container.

The closure according to the present invention may be made of any suitable synthetic plastics material, however it is preferred that it is formed from a suitable grade of polyethylene or polypropylene. The top cap may be formed from a different plastics material to that of the remainder of the closure. The sealing rib of the main closure is preferably formed integrally with its top portion, however, it can be envisaged in another embodiment that at least the sealing rib is formed separately from the main closure and inserted therein.

It will be apparent to persons skilled in the art that numerous modifications may be made to the main closure described in this specification without departing from the scope of the invention as earlier defined. The main closure may, for instance, be provided with a tamper evident band adapted to provide an indication of removal or attempted removal of the main closure from a container. The tamper evident band can extend from the skirt portion by connection through a frangible connection, such as a plurality of frangible bridges. Each bridge can be angled relative to the axis of the closure. The band can have a generally cylindrical body portion and a segmented rib extending inwardly of the body portion and adapted to provide a lip having an inner free edge to engage under a retaining flange extending outwardly from the end portion of the container. In one embodiment, below each rib segment and extending inwardly of the body portion there can be a radially inward projection that extends from proximate the free end of the band to the rib segments. In a preferred embodiment, each rib segment has a corresponding radially inward projection. In this embodiment, each radially inward projection can abut its corresponding rib segment preferably about midway along each segment.

The combined length of the segmented ribs on the band can be equal to at least 50% of the internal circumference of the band. Each of the rib segments can be equally spaced about the internal circumference of the band and separated from each other by a gap. Each of the rib segments can each have an upper surface facing generally towards the top portion of the main closure and an underside facing generally away from the top portion, with the inner surface of the band having a plurality of radially inward projections extending from above the free edge of the band and not extending beyond the inner free edge of the lip.

The upper surface of each rib segment can extend inwardly of the body portion and can comprise a compound two-part surface having a first surface contiguous with the body portion of the band, which surface slopes inwardly and downwardly away from the top portion, and a second surface which extends radially inwardly from the inner terminus of the first surface and has a slope angle substantially normal, or normal, to the skirt portion of the closure.

The tamper evident band can be joined to the skirt portion of the main closure by a plurality of frangible bridges and at least one non-frangible bridge. The band can further have a substantially L-shaped slot extending through the side wall of the band, the horizontal leg of which terminates directly adjacent to or under the non-frangible bridge, and a weakened frangible region extending from the terminating end of the horizontal leg axially downwardly to the bottom of the band distal the frangible bridges.

Where the main closure has a screw thread on the inner surface of its skirt portion, the thread can be continuous or formed of a series of thread segments. If formed from a series of thread segments, the thread segments can be arranged, starting from a first thread segment distal to the top, along a helical thread locus. Each of the thread segments except the first can be formed with two substantially planar end surfaces that are inclined to the axis of the closure and face away from the top of the closure, that is, they face in the direction that a mould core used to mould the closure was withdrawn. In this specification, the term "substantially planar surface" is used to describe a surface that is nearly actually planar or that is curved provided that it all faces in the defined direction. The first of the thread segments is preferably pointed at its end distal to its one adjacent thread segment to assist in mating the thread on the main closure with a complementary thread on the neck of a container.

The substantially planar ends of the thread segments can also be inclined to a notional radial plane of the main closure extending from the longitudinal axis of the main closure to the end of the respective thread segment such that the ends are inclined to the cylindrical skirt by an angle that is less than the angle that the respective notional plane makes with that skirt.

To assist in the venting of gas that may be present in the container, the spaces between the thread segments in adjacent turns of the thread can be aligned. A groove may also be provided on the inside surface of the skirt of the main closure extending longitudinally thereof through the aligned spaces.

The present application is also directed to a second invention comprising a closure suitable for mounting onto a container, the container having an end portion defining a container opening, the closure comprising:

a top portion having an aperture therethrough;

a skirt portion depending downwardly from the top portion that is attachable to the container end portion;

a spout extending upwardly from the top portion, the spout defining a bore that is in fluid communication with the aperture in the top portion, an outer surface of the spout having at least one outwardly extending protuberance thereon;

a plug member having a radially outer surface and mounted to the spout; and a sealing rib that, on attachment of the closure to a container, forms a seal with the end portion of the container, the sealing rib comprising an annular sealing rib adapted to seal with the end portion of the container, the sealing rib projecting downwardly from an underside of the top portion and including a first portion which is contiguous with the top portion and has an inner surface, which inner surface lies radially inwardly of the skirt portion, and at least a second portion contiguous with the first portion and separated from the top portion by the inner surface of the first portion, the second portion extending radially inwardly to a circular edge, the inner surface of the first portion having an internal diameter relative to the external diameter of the end portion of the container to which the closure is to be attached such that during attachment of the closure with the end portion of the container, the sealing rib will be engaged by the end portion of the container so folding the second portion at least towards the inner surface of the first portion of the rib to form a seal between at least an outer surface of the end portion of the container and the closure.

The closure according to the second invention can have a plurality of outwardly extending protuberances on the outer surface of the spout. In this case, between about 10 and 30 protuberances, more preferably between about 15 and 20, and most preferably about 18 protuberances, extend outwardly from the outer surface of the spout. The protuberances can be circumferentially disposed on the outer surface of the spout. In this embodiment, the protuberances can also be equally spaced on the outer surface of the spout.

The present application is also directed to a third invention comprising a container sealed by a closure as defined above.

The present application is also directed to a fourth invention comprising a method of sealing a container comprising the step of mounting a closure as defined above to the neck of the container.

The present application is also directed to a fifth invention comprising a mould for forming a main closure as defined above.

BRIEF DESCRIPTION OF DRAWINGS

The following description of a preferred embodiment of the present invention is provided as an example of the invention and is described with reference to the accompanying drawings, in which.

BEST MODE OF CARRYING OUT THE INVENTION

The closure 5 according to the present invention when put together comprises the main closure 10, the top cap 50, and an overcap 90.

Figure 5:
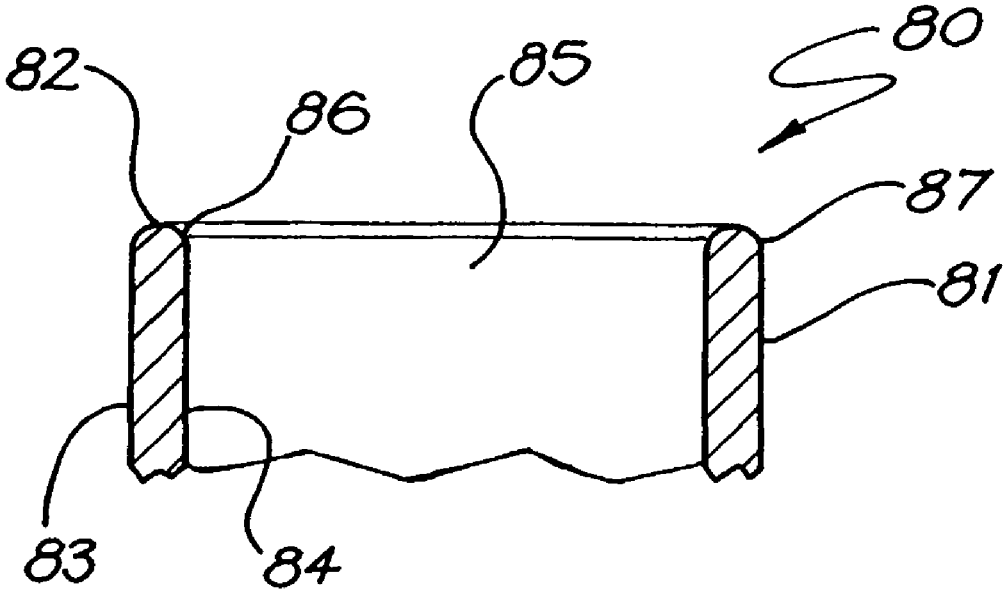
FIG. 5 depicts a free end of one example of a container that can be sealed by the closure according to the present invention.

An example of a bottle 80 to be sealed by the closure according to the present invention is formed from polyethylene terephthalate (PET) and can be used for aerated, carbonated or still beverages. The end portion 81 of the bottle 80 has a free end 82, an outside cylindrical surface 83 and an inside cylindrical surface 84, with the inside surface 84 defining a bore 85. The join between the free end 82 and the inside surface 84 and the join between the free end 82 and the outside surface 83 are each smoothly curved and define respectively inner and outer sealing radii 86,87 of the end portion 81 of the bottle 80. While the present closure can seal bottles 80 having the end portion 81 as depicted in FIG. 5, it will be readily appreciated that the closure can seal bottles having different end portion configurations, such as no outer or inner sealing radii, or only one of the outer or inner sealing radii.

The main closure 10 comprises a circular top 11 and a depending skirt 12. The radially inside surface of the skirt 12 is provided with a segmented screw thread 13 that is adapted to mate with a corresponding thread on the neck of a bottle 80 to which the main closure 10 is adapted to be attached. While the embodiment of the main closure depicted in FIG. 1 has a segmented screw thread 13 extending along a helical locus on the inside surface of the skirt 12, it will be appreciated by persons skilled in the art that the thread could be continuous. Other suitable mechanisms for attaching the main closure 10 to the bottle would also be immediately apparent to a person skilled in the art. The corresponding thread on the neck of the container 80, if present, is also preferably continuous.

The radially outside surface of the skirt 12 carries a series of fine vertical ribs 14. The fine ribs 14 in the depicted embodiment terminate at the lower edge of the skirt 12 in a narrow circumferential rib 15.

A sealing rib 16 is provided on the underside of the top 11 of the main closure 10. The rib 16 is continuous and annular. Seen in cross-section the rib 16 has a first portion 17 and a second, frusto-conical, portion 18. The first portion 17 is contiguous with the top 11 and is spaced radially inwardly from the skirt 12. While depicted spaced radially inwardly from the skirt 12, it will be appreciated that in other embodiments, the first portion 17 could be positioned such that it abuts the skirt 12 or it could comprise an integral thickening of the skirt portion 12 adjacent the top 11. The inner surface 19 of the first portion 17 is substantially cylindrical, while the second portion 18 is of substantially constant thickness as it extends radially inwardly from its outer edge which is contiguous with the lower end of the first portion 17. While depicted as being of substantially constant thickness, it will be appreciated by a person skilled in the art that the second portion 18 could taper slightly in thickness as it extends radially inwardly from its outer edge. A sharp edge 21 is formed between the first portion 17 and the second portion 18. This sharp edge 21 defines a line of weakness between the two portions 17,18.

The second portion 18 of the rib 16 also has formed on its upper surface and proximate its free edge, a continuous annular ridge 22. The underside of the top 11 has formed on its surface inwardly of the first portion 17 a continuous annular ridge 23. When the main closure 10 is mounted to and turned relatively on to the end portion 81 of the bottle 80, the second portion 18 contacts the free end 82 of the bottle 80 and is caused to fold up towards and, in this embodiment, against the inner surface 19 of the first portion 17. As the main closure 10 is further relatively turned on to the end portion 81, contact is made between the underside of the top 11 and the ridge 22 on rib 16 and between the ridge 23 and the upper surface of the second portion 18.

Upon still further relative turning on of the main closure 10 to the end portion 81, the ridge 22 abuts with the ridge 23 thereby ensuring at least part of the second portion 18 is wedged between the free end 82 of the bottle 80 and the underside of the top 11, ie. the movement attaching the main closure 10 tends to pinch the second portion 18 of the rib 16 between the free end 82 of the bottle 80 and the underside of the top 11. This in turn pulls the second portion 18 tightly in towards the outer sealing radius 87 and the cylindrical outer surface 83 of the end portion 81 to produce a tight seal that extends from the free end 82 around the outer sealing radius 87 and down onto at least the outer surface 83 of the end portion 81 of the bottle 80.

Attached to the free end of the skirt 12 of the main closure 10 is a tamper evident band 24 that is adapted to provide an indication of removal or attempted removal of the main closure 10 from the bottle 80. While the band can take a number of forms, the depicted tamper evident band 24 is connected to the skirt 12 by a plurality of frangible bridges 25 spaced about the circumference of the free edge of the skirt 12.

The band 24 has a cylindrical body portion 26 and a plurality of spaced rib segments 27 that extend inwardly of the body portion 26 and which are adapted to provide a lip having an inner free edge to engage under a retaining flange extending outwardly from the end portion 81 of the bottle 80 below the screw thread thereon. Below each rib segment 27 and extending inwardly of the body portion 26 is a radially inwardly extending projection 28 that extends from the free end of the body portion 26 to a position about midway along each rib segment 27.

The upper surface of each rib segment 27 extending inwardly of the body portion 26 can comprise a first surface 29 contiguous with the body portion 26 of the band 24, which surface slopes inwardly and downwardly away from the top portion 11, and a second surface 31 which extends radially inwardly from the inner terminus of the first surface 29 and has a slope angle substantially normal to the skirt 12 of the main closure 10.

On attachment to the end portion 81 of the bottle 80, the inward projections 28 allow the rib segments 27 to ride out and over the retaining flange on the end portion 81 of the bottle 80 without damaging the frangible bridges 25. When the main closure 10 is removed from the bottle 80, the rib segments 27 catch underneath the retaining flange on the bottle 80 so leading to breakage of the frangible bridges 25. The band 24 is thereby retained on the end portion 81 of the bottle 80. Breakage of the bridges 25 provides an indication to a consumer that the main closure 10 has been previously removed from the bottle 80.

The top 11 has a centrally located aperture 32 therethrough and a spout 33 extending upwardly from the top 11. The spout 33 has a wall 34 defining a bore 35 that is in fluid communication with the aperture 32 in the top 11.

The wall 34 of the spout 33 has a substantially cylindrical outer surface 37 extending from its free end 38 to a threaded region 39. The external diameter of the threaded region 39 is greater than that of the outer wall 34 of the spout 33 extending downwardly from the free end 38.

Circumferentially disposed around and extending outwardly from the outer surface 37 is a plurality of equally spaced protuberances or nubs 40. The depicted protuberances 40 are each rectangular in shape and are about 1.1 mm wide, about 1.3 mm high, and are spaced apart by a distance of about 1.1 mm. Each protuberance also has a thickness of about 0.1 mm. The upper and lower edges of each protuberance 40 are each joined to the external surface of the spout 33 with a smoothly curved transition that serves to allow the seal 59 to slide over the protuberances 40 without catching. The side edges of the protuberances extend perpendicularly from the spout 33. The side edges of adjacent protuberances 40 define therebetween a channel that facilitates release of gases from within the container as the seal 59 rides up and out over the protuberances 40.

A plug 36 is mounted to the spout 33 and is located external to and in line with the bore 35. The location of the plug 36 is such that an aperture 41 exists between the plug 36 and the spout 33. The depicted aperture 41 is spanned by a three equally spaced bridge members 42 that extend radially inwardly and upwardly from the spout 33 to support the plug 36 to the spout 33. The plug 36 comprises a tube having a substantially cylindrical outer surface that extends upwardly beyond the extent of the free end 38 of the spout 33 and has a sealed end 43 that is distal the free end 38 of the spout 33.

Figure 1:
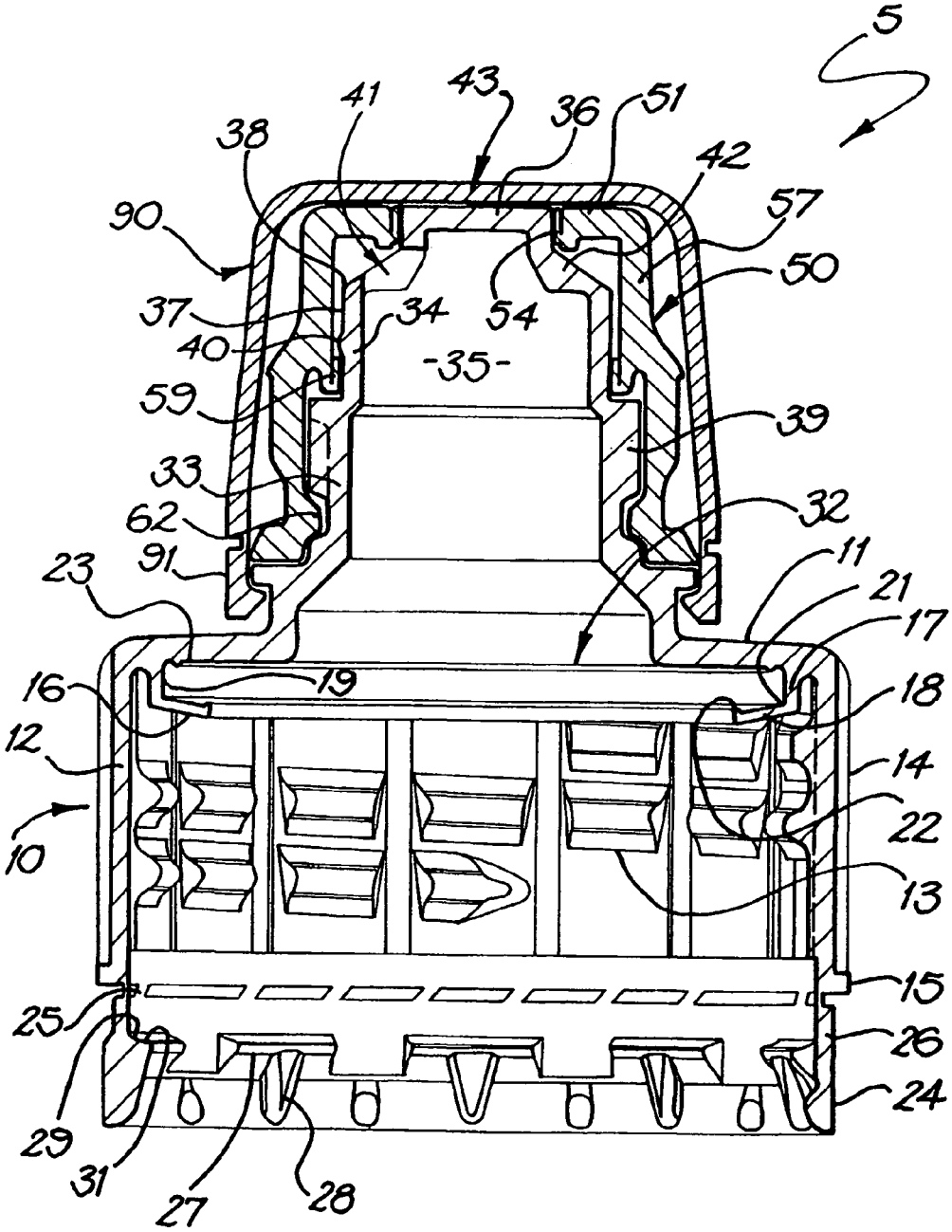
FIG. 1 is a sectional view through the closure according to the present invention.

The top cap 50 that is mountable to the spout 33 has an upper portion 51 that defines an opening through the upper portion 51. As depicted in FIG. 1, the opening is adapted to relatively receive the plug 36 on spout 33 and is further described below. Prior to the plug 36 firstly relatively entering the opening from beneath, on mounting of the top cap 50 to the spout 33 and adopting a first position relative to the spout 33, a sealing rib 54 extends radially inwardly from the surface of the opening in the upper portion 51. The rib 54 is frusto-conical in form, of substantially constant thickness, and extends radially inwardly to a circular free edge. At the line of meeting of the inner surface and the sealing rib, a sharp edge can be provided that defines a line of weakness between the inner surface and the rib. Such a sharp edge assists even deformation of the rib 54 relative to the inner surface when the plug 36 firstly relatively enters the opening from beneath and then folds back the sealing rib 54 towards and, in this embodiment, against the inner surface, as is depicted in FIG. 1. By being folded back against the inner surface, the sealing rib 54 bears strongly against at least the outside surface of the plug 36 and so forms a seal between the top cap 50 and the plug 36 when the plug 36 is within the opening.

Once the sealing rib 54 has been folded back towards the inner surface as the plug 36 firstly relatively enters the opening 53, the sealing rib 54 will normally substantially retain this position during any subsequent movement, including longitudinal movement or rotational movement, of the top cap 50 relative to the spout 33.

The top cap 50 has a skirt 57 depending downwardly from its upper portion 51.

The top cap 50 depicted in FIG. 1 and FIGS. 3*a*-3*c* also has a secondary sealing rib 59. The rib 59 has a frusto-conical portion 59*b* that extends radially inwardly and downwardly to a free edge. The inner surface of the skirt of the top cap 50 has a substantially cylindrical inner surface while the frusto-conical portion 59*b* is of substantially constant thickness along its length. When the top cap 50 is firstly mounted to the spout 33, the second frusto-conical portion 59*b* is engaged by the surface of the spout 33 and folded back towards, and preferably against, the inner cylindrical surface of the spout to form a secondary seal between the spout 33 and the top cap 50.

It will be appreciated that the distance of the second portion 59*b* from the upper portion 51 of the top cap 50 and the length of the second portion 59*b* will govern the overall position of the seal formed between the secondary sealing rib 59 and the spout 33. When the top cap 50 is fully turned down on to the spout, the sealing rib 59 seals with the outer surface of the spout below the protuberances 40 thereon (see FIG. 3*a*). When the top cap 50 is moved relatively upwardly relative to the spout, the sealing rib 59 rides up over the protuberances 40 serving to break the seal made by the rib 59 with the spout (see FIG. 3*b*). As this seal is broken, it is preferred that the seal made by the rib 54 with the plug 36 is still maintained serving to ensure that any release in pressure in the container is initially downwards through the broken seal caused by the protuberances 40 and out of the bottom end of the top cap 50. This has the advantage of stopping a sudden release of pressure through the opening in the top cap 50 on release of the rib 54 from plug 36.

Figure 3C:
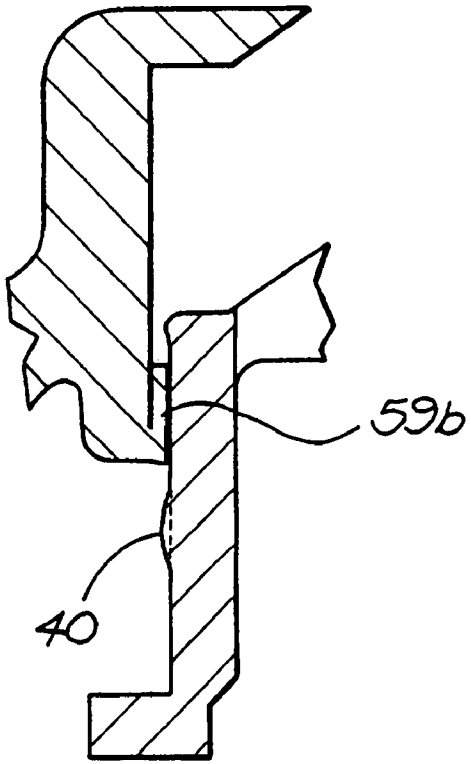
FIGS. 3*a*-3*c* depict enlarged cross-sectional views of the upper end of one embodiment of a top cap mounted to the spout of the main closure.
Figure 3B:
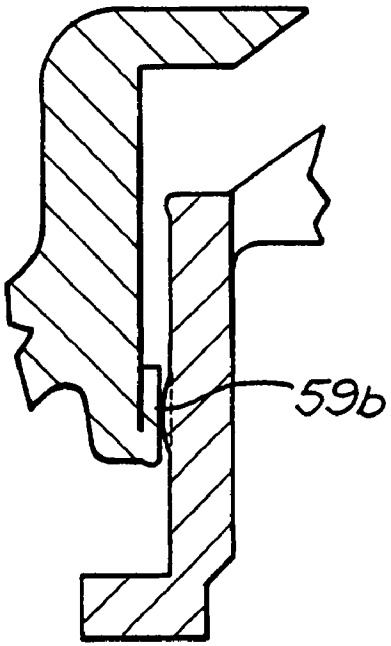
Figure 3A:
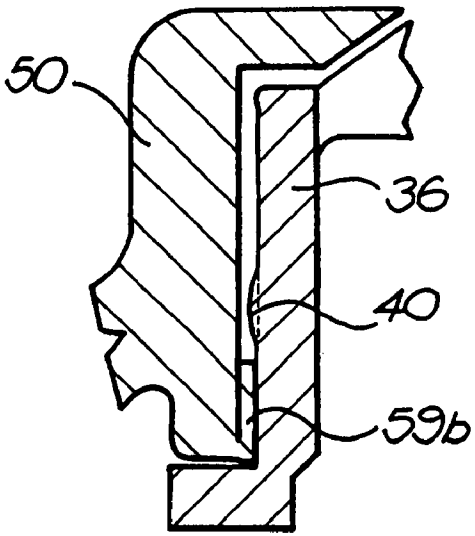

While the seal is broken as the rib 59 rides up and over the protuberances 40, the seal is preferably restored when the rib 59 is positioned relatively above the protuberances 40 (see FIG. 3*c*). This has the advantage of ensuring that the contents of the container, such as an aerated or carbonated beverage, only exit through the opening in the top cap 50, with none dribbling down the outer surface of the spout 33 and out of the bottom end of the top cap 50.

Once the secondary sealing rib 59 has been folded back when the top cap 50 is mounted to the plug 36, the rib 59 will normally substantially retain this position during any subsequent movement, including longitudinal and rotational movement, of the top cap 50 relative to the spout 33.

Figure 4C:
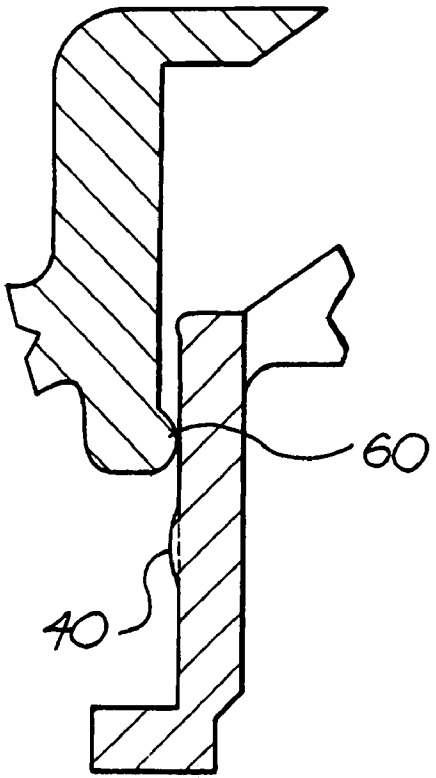
FIGS. 4*a*-4*c* depict enlarged cross-sectional views of the upper end of another embodiment of a top cap mounted to the spout of the main closure.
Figure 4B:
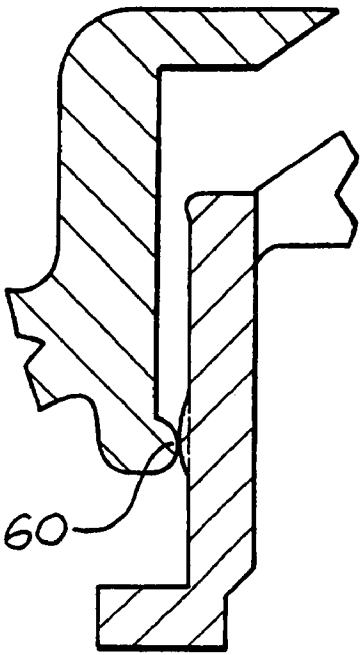
Figure 4A:
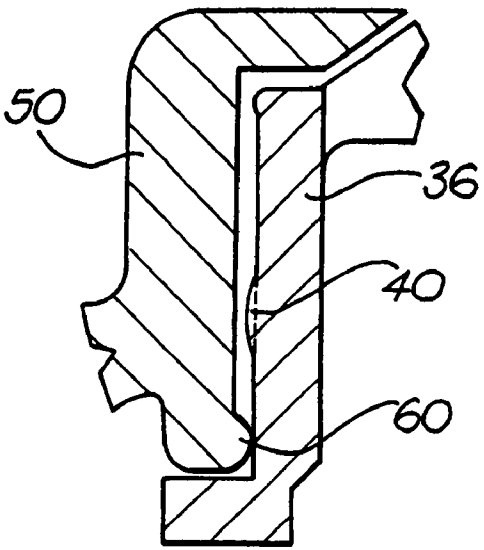

In the embodiment depicted in FIGS. 4*a*-4*c*, the sealing rib 59 is replaced with a bead 60 that is adapted to contact the outside wall of the spout 33 when the top cap 50 is mounted to the spout 33 (see FIG. 4*a*). As with the sealing rib 59, the seal provided by bead 60 is broken as it rides up and over the protuberances on relative upward movement of the top cap 50 on the spout (see FIG. 4*b*). The seal provided by the bead 60 with the outer surface of the spout is restored when the bead is above the protuberances (see FIG. 4*c*). The bead 60 therefore also serves to help prevent the bottle's contents, such as a carbonated or aerated beverage, from leaking down the side of the spout 33 between the spout 33 and the top cap 50 even when the top cap 50 is moved to its second position.

The inside cylindrical surface of the skirt 57 of the top cap 50 also has thread segments 62 adapted to engage complementary thread recesses 44 in the wall of the spout 33 when the top cap 50 is mounted to the spout 33.

Figure 2:
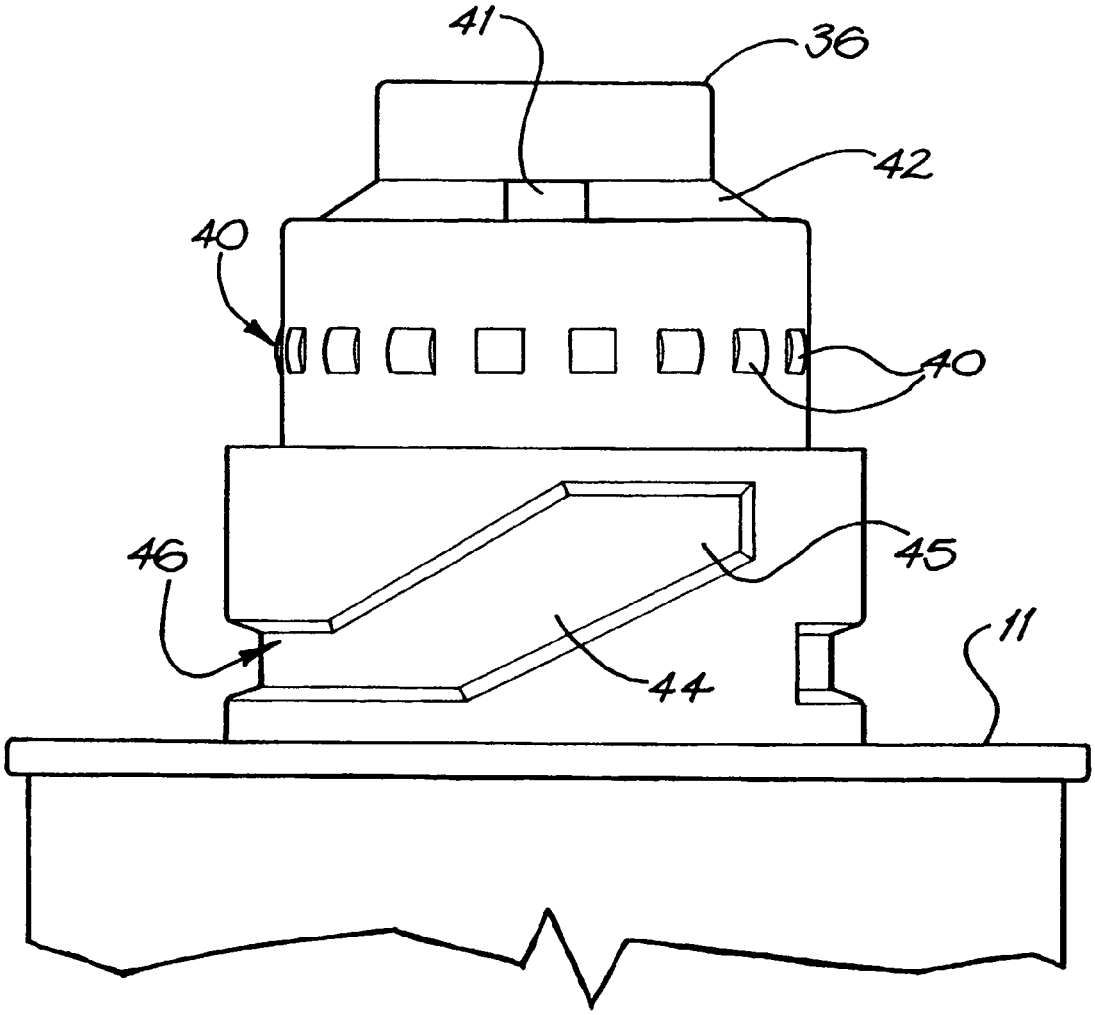
FIG. 2 is a side elevational view of the spout of the main closure.

Each thread recess 44 includes an upwardly directed ramp member 45 and a holding area 46 (best depicted In FIG. 2). The ramp members 45 are so located that on rotation of the top cap 50 relative to the spout 33, the thread segments 62 enter and move up the respective ramp members 45 so moving the top cap 50 relatively upwardly on the spout 33. The relative upward movement of the top cap 50 serves to disengage the plug 36 from the opening in the upper portion 51 of the top cap 50. Rotation of the top cap 50 in the opposite direction returns the thread segments 62 down the respective ramp members 45 and into the holding areas 46.

The depicted respective ramp members 45 are formed at an angle of about 30 degrees relative to a notional radial plane normal to the skirt 57 of the top cap 50. Other angles can be envisaged, for example, the ramp member could be disposed at an angle of about 45 degrees to the notional radial plane normal to the skirt 57. When the top cap 50 is firstly mounted to the spout 33, the top cap 50 is pushed relatively downwardly onto the spout 33 such that the thread segments 62 engage within the thread recesses 44 on the spout 33.

The overcap 90 is provided with a tamper evident band 91 that provides an indication of movement or attempted movement of the top cap 90 relative to the spout 33 after the overcap 90 has been mounted on the spout 33. The tamper evident band 91 is connected to the skirt of the overcap by a frangible region. The overcap acts to protect and keep clean the top cap 50 while the closure 10 is sealed to the bottle 80. A shrink wrap plastic sheet can also be applied about the bottle 80 and the closure once the closure is sealed to the bottle 80 to protect and keep clean the top cap 50.

The main closure 10 and top cap 50 can be fabricated from polyethylene by injection moulding. Other suitable materials and fabrication techniques can be readily envisaged.

The main closure 10 and top cap 50 will normally be moulded separately in appropriate moulds before the top cap 50 is mounted to the spout 33. At mounting, the sealing ribs 54 and 59 will be folded back and seal respectively with the plug 36 and spout 33, and the thread segments 62 also engage within the thread recesses 44. The bottle 80 is filled with a carbonated, aerated or other beverage before the entire closure is turned onto the end portion 81 so forcing the rib segments 27 on band 24 of the main closure 10 over the retaining flange on the end portion 81 of the bottle 80. As the main closure 10 is turned onto the end portion 81, the second portion 18 of the sealing rib 16 is also folded back and seals with at least the outer surface 83 of the end portion 81 of the bottle 80. The closure has then sealed the bottle 80.

To access the beverage, the consumer has two choices. Firstly, they can choose to remove the entire closure 5 by simply unscrewing the main closure 10 from the end portion 81 so breaking the frangible bridges 25.

Alternatively, the consumer can choose to remove the overcap 90 and turn the top cap 50 so relatively disengaging the plug 36 from the opening in the upper portion of the top cap 50. During turning of the top cap 50, the sealing rib 59 or, if used, bead 60, ride up over the protuberances 40 thereby releasing, at least for a period of time, the seal formed between the rib 59 or bead 50 with the outer surface of the spout 33.

Once the plug 36 is disengaged, the beverage can then be poured through the spout 33 and exit the bottle 80 through the annular aperture 41 and opening, with leakage of the beverage between the spout 33 and inside surface of the skirt 57 prevented or at least substantially prevented by the sealing rib 59 or, if used, annular bead 60 again making a seal with the outer surface of the spout above the protuberances 40. If the consumer wishes to reseal the bottle 80, the top cap 50 is counter-rotated returning the plug 36 into the opening in the top cap 50.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A closure suitable for mounting onto a container, the container having an end portion defining a container opening, the closure comprising:

a main closure having:

a top portion having an aperture therethrough;

a skirt portion depending downwardly from the top portion that is attachable to the container end portion;

a main closure sealing rib that, on attachment of the main closure to a container, forms a seal with the end portion of the container;

a spout extending upwardly from the top portion, the spout defining a bore that is in fluid communication with the aperture in the top portion, an outer surface of the spout having a plurality of outwardly extending protuberances thereon; and a plug member having a radially outer surface and mounted to the spout; and a top cap mounted to the spout, the top cap having an upper portion that has an inner surface defining an opening through the upper portion, the opening being in fluid communication with the bore of the spout, a substantially cylindrical skirt portion depending downwardly from the upper portion, and a top cap sealing member extending inwardly from an inside surface of the top cap;

the top cap being relatively movable between a first position where the plug member is at least partially within the opening and the top cap sealing member forms a seal with the outer surface of the spout and at least a second position where the plug member is withdrawn from the opening; and wherein on relative movement of the top cap from said first position towards said second position, the top cap sealing member rides up over said protuberances so as to at least partially release the seal made by the top cap sealing member with said spout;

and further wherein the top cap sealing member comprises an annular sealing rib that on mounting of the top cap to the spout in said first position seals with the outer surface of the spout below the protuberances thereon, the annular sealing rib including a first portion which is contiguous with an inner surface of the skirt portion of the top cap and at least a second portion contiguous with the first portion, the second portion, prior to mounting of the top cap to the spout, extending radially inwardly to a circular free edge.

2. The closure of claim 1 wherein the second portion extends inwardly and downwardly to the circular free edge.

3. The closure of claim 2 wherein the second portion of the annular sealing rib is frusto-conical.

4. The closure of claim 1 wherein on mounting of the top cap to the spout, the second portion is folded back at least towards the first portion.

5. The closure of claim 4 wherein the second portion is folded back against the first portion on mounting of the top cap to the spout.

6. The closure of claim 1 wherein the top cap sealing member comprises an annular contact bead that on mounting of the top cap to the spout in said first position seals with the outer surface of the spout below the protuberances thereon.

7. A closure suitable for mounting onto a container, the container having an end portion defining a container opening, the closure comprising:

a main closure having:

a top portion having an aperture therethrough;

a skirt portion depending downwardly from the top portion that is attachable to the container end portion;

a main closure sealing rib that, on attachment of the main closure to a container, forms a seal with the end portion of the container;

a spout extending upwardly from the top portion, the spout defining a bore that is in fluid communication with the aperture in the top portion, an outer surface of the spout having a plurality of outwardly extending protuberances thereon; and a plug member having a radially outer surface and mounted to the spout; and a top cap mounted to the spout, the top cap having an upper portion that has an inner surface defining an opening through the upper portion, the opening being in fluid communication with the bore of the spout, a substantially cylindrical skirt portion depending downwardly from the upper portion, and a top cap sealing member extending inwardly from an inside surface of the top cap;

the top cap being relatively movable between a first position where the plug member is at least partially within the opening and the top cap sealing member forms a seal with the outer surface of the spout and at least a second position where the plug member is withdrawn from the opening; and wherein on relative movement of the top cap from said first position towards said second position, the top cap sealing member rides up over said protuberances so as to at least partially release the seal made by the top cap sealing member with said spout;

and wherein the top cap sealing member comprises a top cap sealing rib that, prior to mounting of the top cap to the spout, extends inwardly and downwardly from an inner surface of the top cap to a circular edge.

8. The closure of claim 7 wherein on mounting of the top cap to the spout, the top cap sealing rib is folded back at least towards the inner surface of the top cap.

9. The closure of claim 8 wherein the top cap sealing rib is folded back against the inner surface of the top cap.

10. The closure of claim 7 wherein the top cap sealing rib is frusto-conical.

11. A closure suitable for mounting onto a container, the container having an end portion defining a container opening, the closure comprising:

a main closure having:

a top portion having an aperture therethrough;

a skirt portion depending downwardly from the top portion that is attachable to the container end portion;

a main closure sealing rib that, on attachment of the main closure to a container, forms a seal with the end portion of the container;

a spout extending upwardly from the top portion, the spout defining a bore that is in fluid communication with the aperture in the top portion, an outer surface of the spout having a plurality of outwardly extending protuberances thereon; and a plug member having a radially outer surface and mounted to the spout; and a top cap mounted to the spout, the top cap having an upper portion that has an inner surface defining an opening through the upper portion, the opening being in fluid communication with the bore of the spout, a skirt portion depending downwardly from the upper portion, and a top cap sealing member extending inwardly from an inside surface of the top cap;

the top cap being relatively movable between a first position where the plug member is at least partially within the opening and the top cap sealing member forms a seal with the outer surface of the spout and at least a second position where the plug member is withdrawn from the opening; and wherein on relative movement of the top cap from said first position towards said second position, the top cap sealing member rides up over said protuberances so as to at least partially release the seal made by the top cap sealing member with said spout;

and wherein, prior to the plug member firstly entering the opening in the upper portion of the top cap, an annular sealing rib extends inwardly from the upper portion at least partially across the opening to a free edge, the inner surface of the opening having an internal diameter relative to the external diameter of the plug member such that when the plug member firstly enters the opening, at least a portion of the sealing rib is engaged by the plug member and folded back towards the inner surface of the opening to form a seal between at least the outer surface of the plug member and the top cap.

12. The closure of claim 11 wherein the inner surface of the opening in the upper portion of the top cap is substantially cylindrical and extends from an upper side to an underside of the upper portion.

13. The closure of claim 12 wherein the annular sealing rib, prior to the plug member firstly entering the opening in the upper portion of the top cap, has at least a frusto-conical portion extending radially inwardly to a circular free edge.

14. The closure of claim 1, 7 or 11 wherein between about 10 and 30 protuberances extend outwardly from the outer surface of the spout.

15. The closure of claim 14 wherein between about 15 and 20 protuberances, more preferably 18 protuberances, extend outwardly from the outer surface of the spout.

16. The closure of claim 1, 7 or 11 wherein the protuberances are circumferentially disposed on the outer surface of the spout.

17. The closure of claim 16 wherein the protuberances are equally spaced on the outer surface of the spout.

18. The closure of claim 1, 7 or 11 wherein the inside surface of the skirt portion of the top cap has an attachment mechanism complementary to an attachment mechanism on an external surface of the spout.

19. The closure of claim 18 wherein the complementary attachment mechanisms comprises a thread adapted to engage a corresponding thread on the external surface of the spout.

20. The closure of claim 1, 7 or 11 wherein the plug member is located at or adjacent an end of the spout distal said opening, with an aperture between the plug member and the spout wall, the aperture being spanned by a plurality of bridge members that extend radially inwardly and upwardly from the spout to support the plug member.

21. The closure of claim 1, 7 or 11 wherein the main closure sealing rib comprises an annular sealing rib adapted to seal with the end portion of the container, the main closure sealing rib projecting downwardly from an underside of the top portion and including a first portion which is contiguous with the top portion and has an inner surface, which inner surface lies radially inwardly of the skirt portion, and at least a second portion contiguous with the first portion and separated from the top portion by the inner surface of the first portion, the second portion extending at least radially inwardly to a circular edge, the inner surface of the first portion having an internal diameter relative to the external diameter of the end portion of the container to which the main closure is to be attached such that during attachment of the main closure with the end portion of the container, the main closure sealing rib will be engaged by the end portion of the container so folding the second portion at least towards the inner surface of the first portion of the rib to form a seal between at least an outer surface of the end portion of the container and the main closure.

* * * * *